United States Patent [19]

Ohnishi et al.

[11] 4,362,078

[45] Dec. 7, 1982

[54] METHOD OF BLANKING

[75] Inventors: Tatsuo Ohnishi; Takeshi Uemura; Teruo Nakajima, all of Osaka, Japan

[73] Assignee: Akzona Incorporated, Asheville, N.C.

[21] Appl. No.: 222,232

[22] Filed: Jan. 5, 1981

[30] Foreign Application Priority Data

Mar. 25, 1980 [JP] Japan ..... 55-036910

[51] Int. Cl.[3] ..... B21D 28/26

[52] U.S. Cl. ..... 83/862; 83/50; 83/51; 83/55

[58] Field of Search ..... 83/862, 865, 49, 50, 83/51, 55, 43, 32

[56] References Cited

U.S. PATENT DOCUMENTS 444,918 1/1891 Mason et al. ..... 83/43
1,439,393 12/1922 Assmann ..... 83/50
1,476,706 12/1923 Furber ..... 83/51 X
2,103,120 12/1937 Sabo et al. ..... 83/862 X
2,561,050 7/1951 Charron et al. ..... 83/55 X

FOREIGN PATENT DOCUMENTS 409662 4/1910 France ..... 83/50

*Primary Examiner*—James M. Meister
*Attorney, Agent, or Firm*—Robert H. Falk; Charles A. Wendel; Francis W. Young

[57] ABSTRACT

A method of blanking wherein an endless V-shaped groove of desired contour is formed on at least one of the top and bottom sides of a material sheet. The groove is shaped so that the external side thereof is at a right angle to the groove-cut surface of the sheet. A blank having the desired contour is then cut out of the sheet along the right-angled external side of the groove.

6 Claims, 32 Drawing Figures

METHOD OF BLANKING

FIELD OF THE INVENTION

This invention relates to a method of blanking which cuts out a blank of desired shape with high precision from a material sheet so as to minimize the generation of scrap.

BACKGROUND OF THE INVENTION

Several methods have been known for cutting out a blank of desired shape from a material sheet. A widely used shearing method which cuts blanks out of freely supported material sheet, and a fine-blanking method which cuts blanks out of material sheet which is firmly fixed by means of a projecting sheet holder, are typical examples.

When continuously cutting out a plurality of blanks from a single material sheet or plate, the former known method needs webs as carriers and bridges that support the material. The metal left over from these webs is scrap, thus greatly lowering the blank-to-material yield (to between 60 and 70 percent). Besides, the bending moment arising at the moment of blanking bends the periphery of the cut-out blank, causing deformation thereof. Specifically, the sheared surface is not right-angled but is tapered with respect to the sheet surface due to the springback of the blank, which thus heavily damages the dimensional accuracy of the blank. Further, the cut edge assumes a complex shape because of the effect of shear droop and deformation, fracture, burrs and so forth (see FIG. 7).

The latter known method provides a blank contour which suffers little blanking deformation since it controls the occurrence of shear droop, fracture and burrs. This naturally results in improved dimensional accuracy. However, wide carriers and bridges must be left to insure contact with a projecting sheet holder. This increases the quantity of scrap and seriously lowers the product-to-material yield (to as low as between 30 and 50 percent; see FIG. 8).

In addition, the material must have high ductility and toughness as well as a uniform, closely packed structure. In being blanked, such material exerts greater pressure against the working face of the tool, causing heavy wearing and shortening of the tool life.

Therefore, the latter method is generally inferior to the former method in respect to productivity and economics.

Now this invention has obviated these shortcomings associated with the aforesaid conventional methods. The method of blanking according to this invention cutting a V-shaped endless groove of desired contour on the top surface, or on both the top and bottom surfaces, of a material sheet so that the external side of the groove is at right angles to the top surface or both top and bottom surfaces of the material. A desired blank is then obtained by precision-shearing along the V-shaped groove by such methods as blanking, punching, lancing and parting.

The following describes embodiments of this invention by reference to the accompanying drawings.

DETAILED DESCRIPTION

Figure 1:
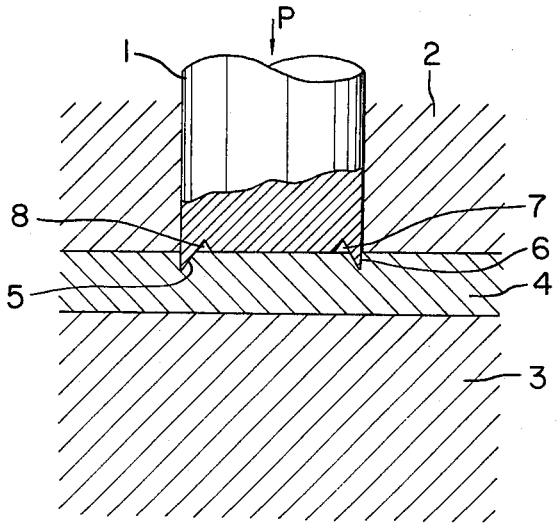
FIG. 1 is a cross-sectional view showing the principal part of a material sheet in which a V-shaped groove is being cut.

As shown in FIG. 1, as a first step, a lancing punch 1 descends along a guide member 2 to cut a V-shaped groove 5 of desired shape on a material sheet or plate 4 placed on a lower die 3. The external side 6 of the V-shaped groove 5 is at right angles to the surface of the material sheet 4. To prevent the lancing edge 7 of the punch 1 from being damaged, it is preferable to make the contained angle of the V-shaped groove 5 small to form a deep groove in case of a soft, high-toughness material, and large to form a shallow groove in case of a hard, low-toughness material.

The cutting of the V-shaped groove 5 reduces the area to be subsequently sheared. Being cold-worked by the lancing edge 7, the surface of the V-groove 5 undergoes work hardening, which lowers toughness. Especially the pointed end of the V-groove 5 greatly lowers shear strength to facilitate the subsequent shearing operation. Namely, the V-shaped groove 5 produces such effects as decreasing the shearing force, preventing deformation in blanking, improving dimensional accuracy and lengthening tool and die life.

The lancing edge 7 of the punch 1 used for cutting the V-shaped groove 5 lets the excess metal resulting from the cutting of the V-shaped groove 5 to escape by providing a clearance groove 8 on the inside thereof.

Figure 2:
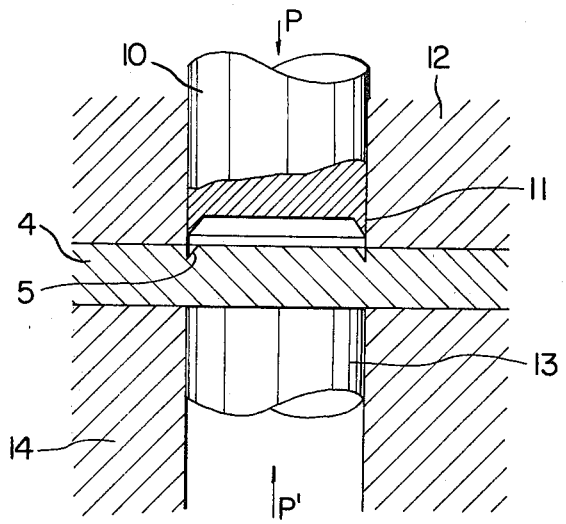
FIG. 2 is a cross-sectional view showing the principal part of the material sheet being sheared.
Figure 3:
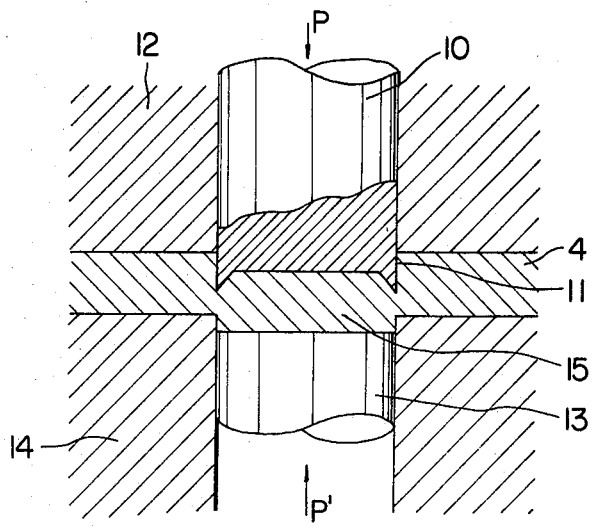
FIG. 3 shows a cross-sectional view showing the principal part of the material sheet being blanked.

Referring now to FIGS. 2 and 3, the second step of blanking will be discussed.

A blanking punch 10 for the second process step is similar to the punch 1 for the first process step, except that the punch 10 has no internal clearance groove. Descending along a guide member 12, the blanking edge 11 of the blanking punch 10 fits into the V-shaped groove 5 formed on the material sheet 4, which sheet 4 rests on a knockout 13 associated with a knockout guide member 14 for preventing the displacement and escape of the material. Holding the contour enclosed by the V-shaped groove 5, the internal taper of the blanking edge 11 pushes the material sheet in the shearing direction. Since the blanking punch 10 and the knockout 13 are concentrically positioned, the knockout 13 descends as the blanking punch 10 descends to complete the punching process, holding a resultant blank therebetween.

This concentrates greater force to the pointed end of the V-shaped groove 5 to increase the effect thereof, thereby confining the plastic deformation due to shearing to the smallest area at the lowermost edge of the pointed end of the V-shaped groove 5. As a consequence, a blank 15 of desired size and shape having a good sheared surface perpendicular to the material surface is obtained.

The knockout 13 supports the material sheet from below to prevent the deformation during blanking, and also permits removal of the finished blank 15.

Figure 4:
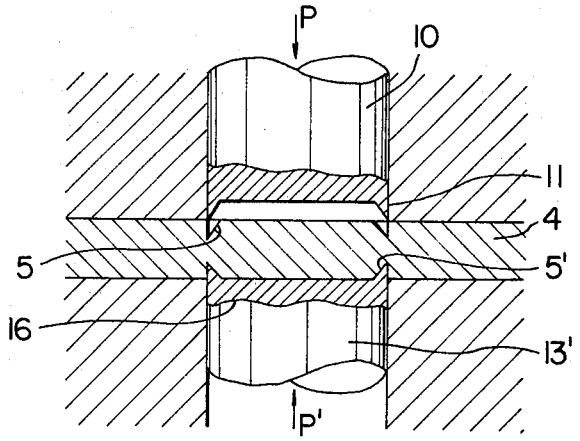
FIG. 4 is a cross-sectional view of another embodiment being sheared.
Figure 5:
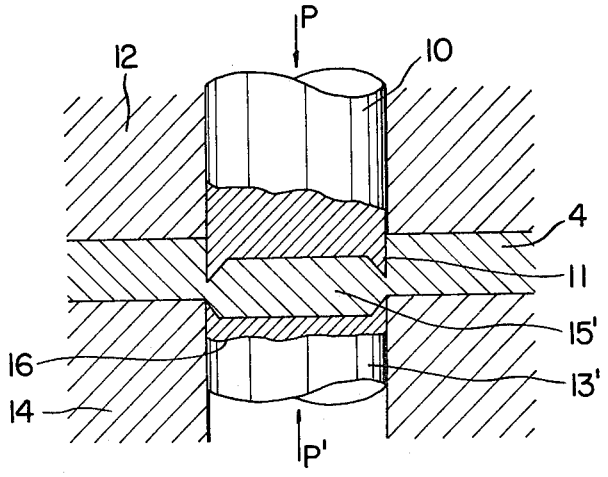
FIG. 5 is a cross-sectional view of the embodiment of FIG. 4 being blanked.

FIGS. 4 and 5 show another embodiment in which V-shaped grooves 5 and 5' are cut on both top and bottom surfaces of the material sheet 4. In this case, a pressure edge 16, adapted to fit in the V-shaped groove 5', is also provided on the knockout 13'.

Accordingly, it is necessary to shear only that part thereof which is left between the V-shaped grooves 5 and 5'. This remarkably reduces the area to be sheared, thereby producing blanks having good sheared surfaces and higher dimensional accuracy.

Generally, metals such as carbon steels and alloy steels for structural use classed as the body-centered cubic lattice group exhibit, in the low temperature zone not higher than ordinary temperatures, increasing tensile strength, yield strength and hardness and decreasing ductility, including elongation and drawability, with decreasing temperature. In addition, below a certain temperature known as the transition temperature, notch toughness drops sharply to give rise to low-temperature brittleness.

Figure 6:
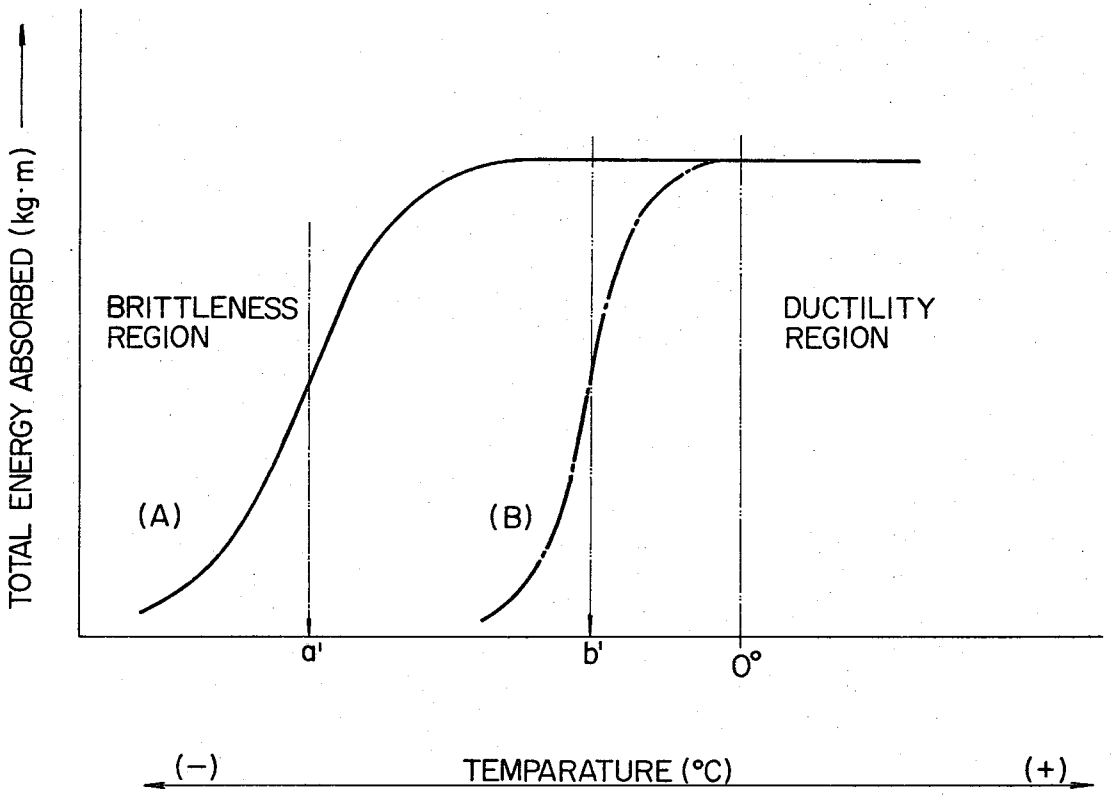
FIG. 6 shows transition temperature curves.
Figure 7:
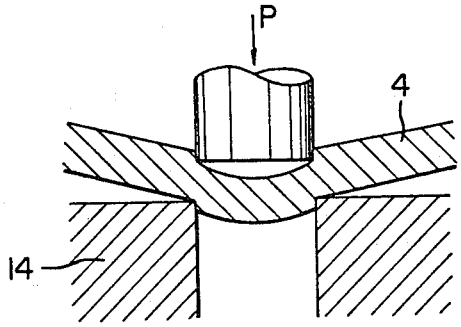
FIG. 7 PRIOR ART
FIG. 7 is a cross-sectional view showing the principal part of a material sheet being sheared according to a conventional method.
Figure 8:
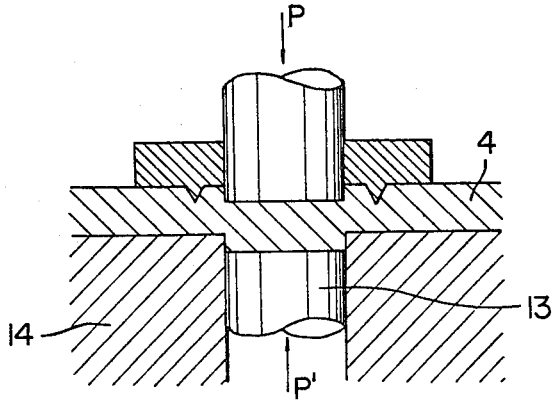
FIG. 8 PRIOR ART
FIG. 8 is a cross-sectional view showing the principal part of a material sheet being sheared according to another conventional method.

The transition temperature range within which this brittleness occurs varies with not only the quality and structure of material, but also the surface condition and strain rate. Especially where a sharp cut exists in the surface or the strain rate is great, the range exhibits a tendency to shift from the low-temperature zone to the ordinary-temperature zone. FIG. 6 graphically compares the transition temperature a' of a material A having a smooth surface and b' of a material B having a groove cut in the surface thereof, clearly evidencing the aforementioned tendency.

By taking advantage of this low-temperature characteristic of the body-centered cubic lattice type metals, the blanking method according to this invention can make the material shearable with greater ease, thereby offering an improvement over the conventional shearing methods. The method according to this invention thus involves cutting a wedge-shaped groove along a desired contour line in the surface of the material sheet, which raises the transition temperature above the level for a smooth surface so as to lower the notch toughness, and then, carrying out the blanking.

Therefore, this method permits shearing of a deformation-free blank with high dimensional accuracy out of high-toughness material at low temperatures by preventing fractures due to cold-working by reducing the shear strength of the material and the required shearing force.

In shearing face-centered cubic lattice metals, such as austenitic stainless steels having high toughness, at low temperatures below the Md point (in metastable austenitic stainless steels, plastic working induces martensitic transformation even at temperatures above the Ms point. The upper limit of this temperature range is called the Md point), the cut groove hardens due to work-induced transformation, thereby lowering ductility and toughness and increasing notch effect. This facilitates blanking, permitting production of blanks with less deformation and higher dimensional accuracy than the conventional products.

As described above, the method according to this invention cuts a V-shaped groove having a desired shape on a material sheet and produces a precision-cut blank by shearing along the V-shaped groove. Accordingly, the obtained blank suffers much less deformation and exhibits much higher dimensional accuracy than ever. Because the contour of the blank does not deform, adjacent blanks can be defined by a common contour or tangential line, and blanked leaving little or no carriers and bridges. This permits increasing the product-to-material yield remarkably (by more than 30 percent over the conventional methods) and minimizing the generation of scrap.

Figure 9A:
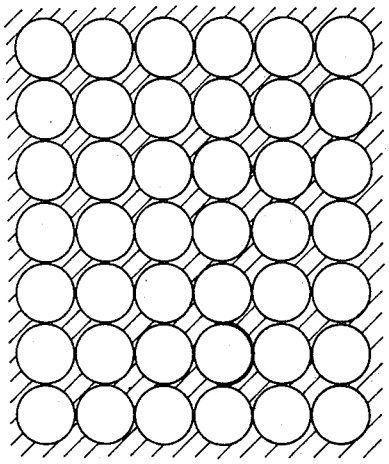
FIGS. 9*a* through 16*c* are blank layouts according to the method of this invention and the conventional methods.
Figure 9B:
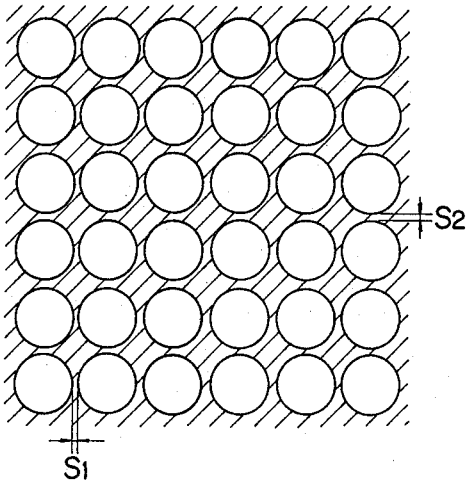
Figure 9C:
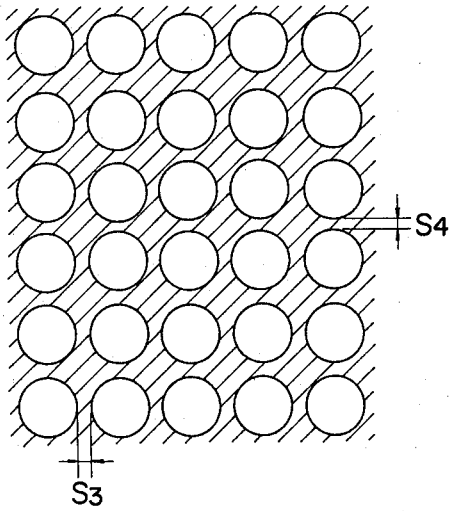
Figure 10:
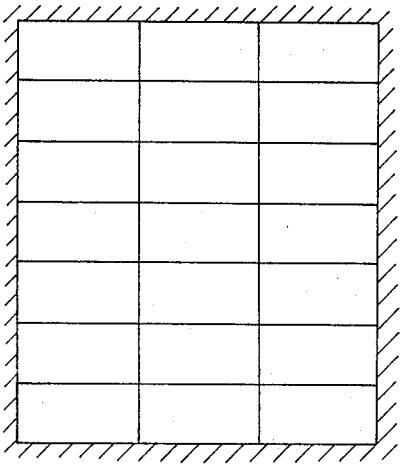
Figure 10:
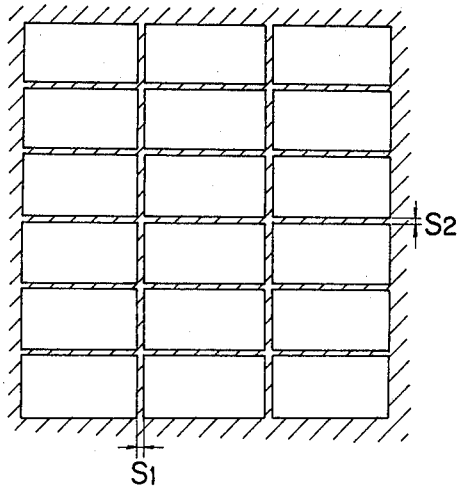
Figure 10:
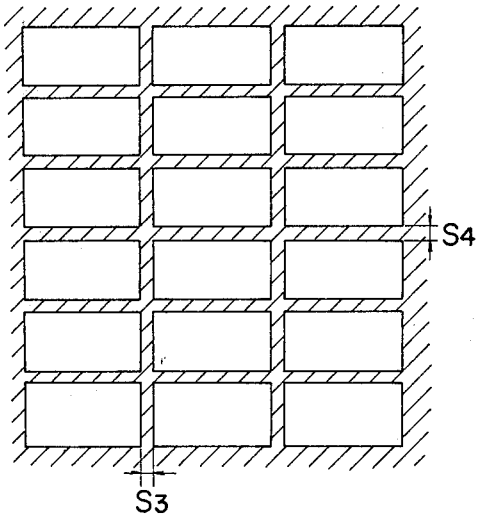
Figure 11A:
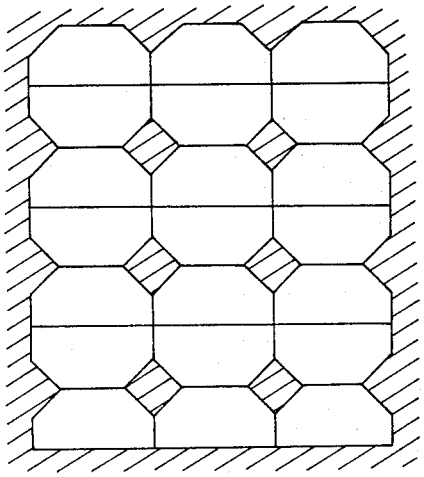
Figure 11B:
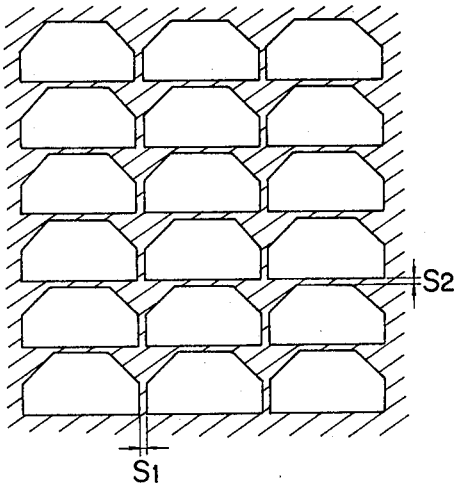
Figure 11C:
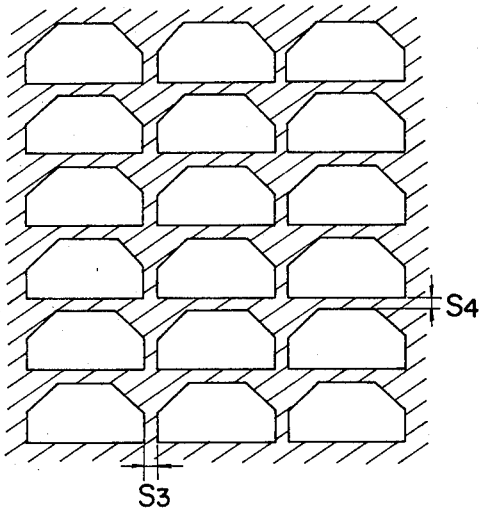
Figure 12:
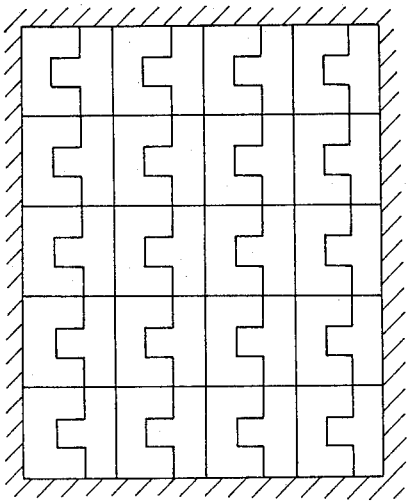
Figure 12:
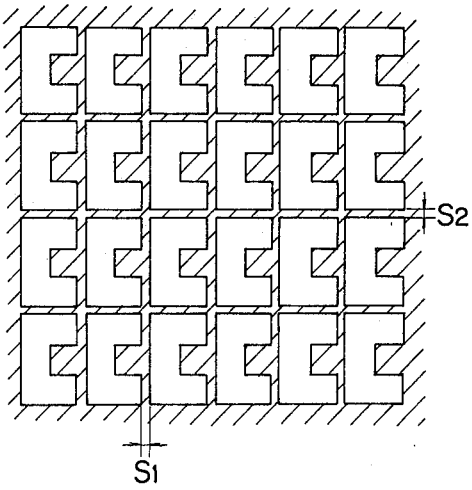
Figure 12:
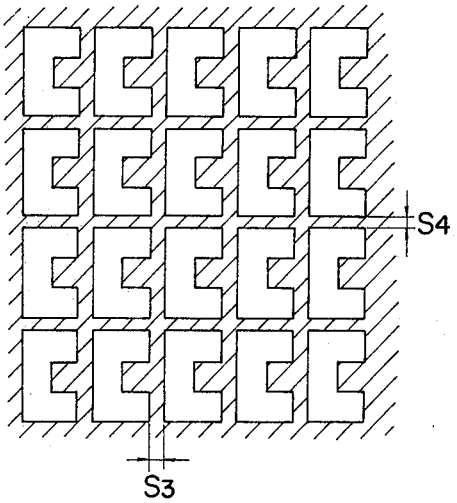
Figure 13:
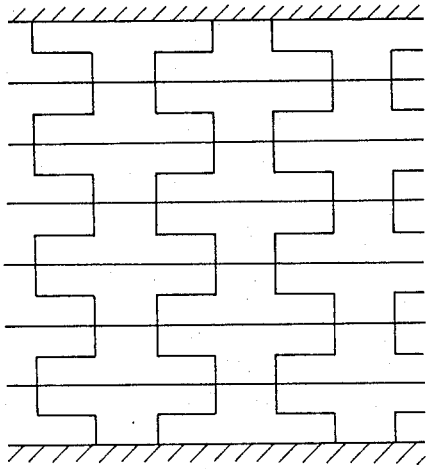
Figure 13:
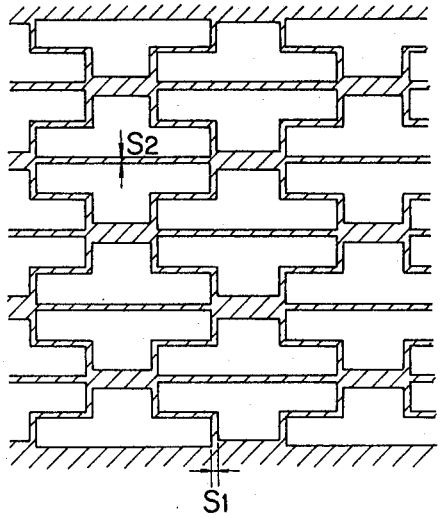
Figure 13:
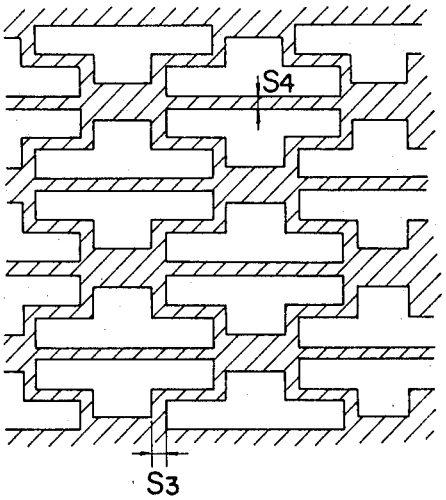
Figure 14:
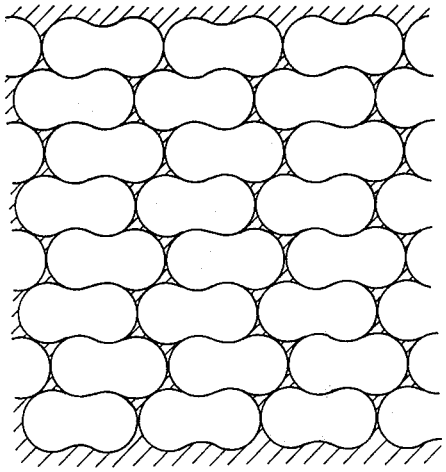
Figure 14:
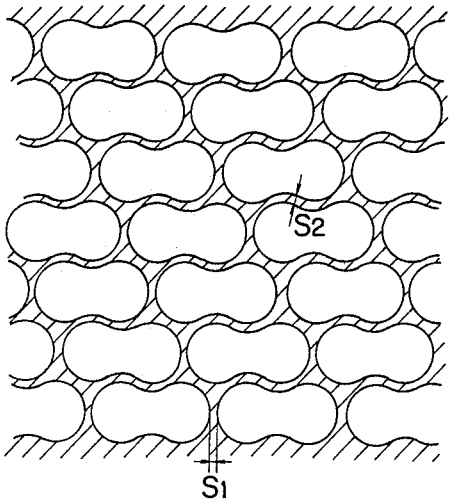
Figure 14:
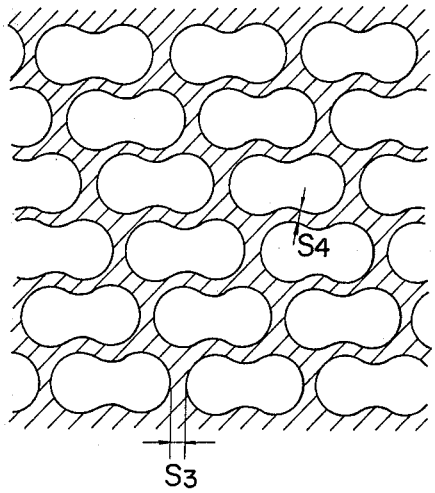
Figure 15:
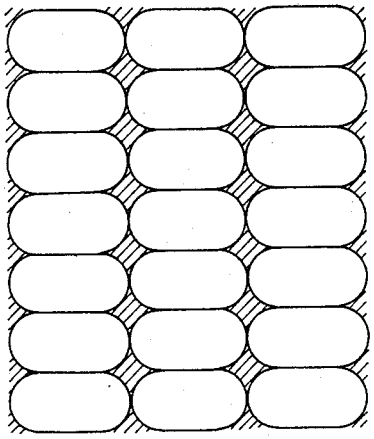
Figure 15:
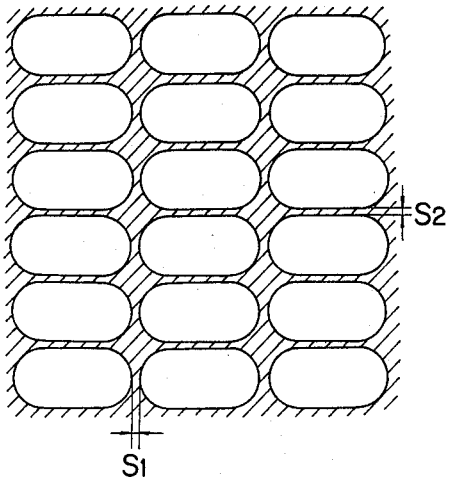
Figure 15:
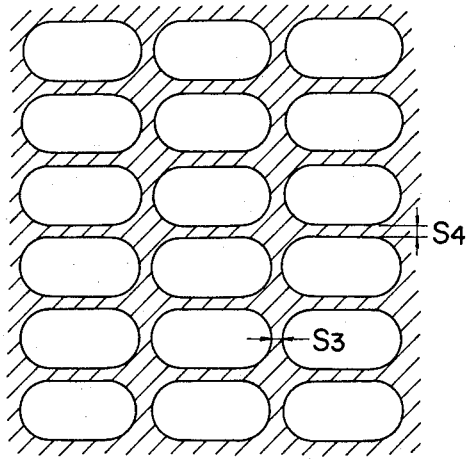
Figure 16A:
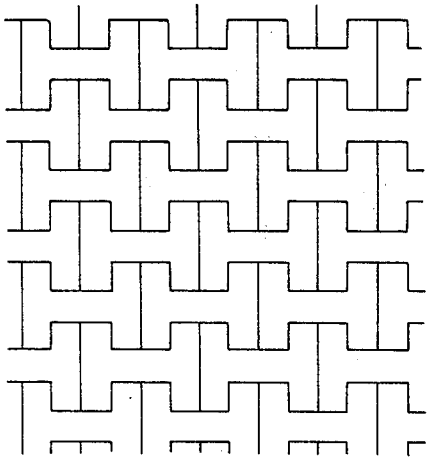
Figure 16B:
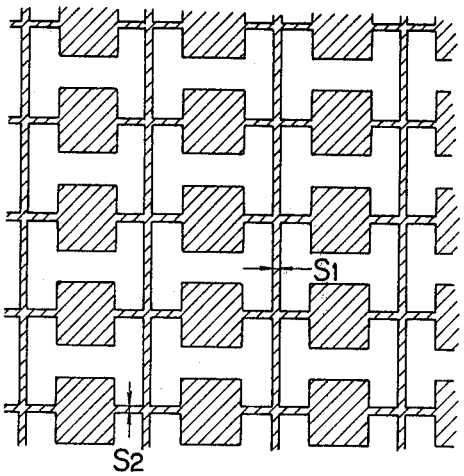
Figure 16C:
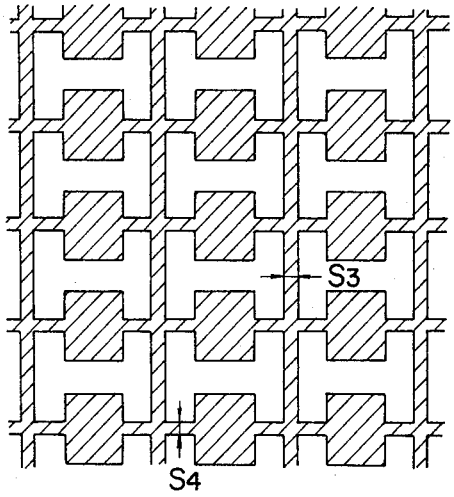

FIGS. 9 through 16 compare the blank layouts according to the method of this invention and conventional methods. Throughout these figures, (a) designates the method of this invention, (b) the conventional shearing method, and (c) the conventional fine-blanking method. Reference characters $S_1$, $S_2$, $S_3$ and $S_4$ denote the widths of web, $S_1$ and $S_2$ being smaller than $S_3$ and $S_4$. FIG. 9 shows the layouts of circular blanks, FIG. 10 those of rectangular blanks, FIG. 11 those of polygonal blanks, FIG. 12 those of indented blanks (permitting simultaneous blanking of projected blanks too), FIG. 13 those of projected blanks, FIG. 14 those of gourd-shaped blanks, FIG. 15 those of elliptical blanks, and FIG. 16 those of H-shaped (or I-shaped) blanks, the hatched part showing the scrap metal left behind after blanking. (Of course, triangular blanks can be likewise produced, though not shown).

As evident from these comparative figures, the blanking method according to this invention is superior to the conventional methods, leaving much less scrap.

What is claimed is:

1. A method of blanking, comprising the steps of: providing a lancing punch having an endless lancing edge projecting outwardly from one end thereof, which lancing edge is of a generally V-shaped cross section with the exterior side of the V-shaped lancing edge extending perpendicular to the material sheet which is to be punched; moving said lancing punch into engagement with a surface of said material sheet for causing the lancing edge to penetrate said surface and form an endless groove in said sheet, which groove projects into said sheet from said surface and has a V-shaped cross section, with the outer peripheral edge of said groove extending at right angles to said surface; positioning said material sheet on a support having a knockout opening therein corresponding to the profile of the proposed blank as defined by said endless groove so that said proposed blank is aligned with and positioned over said knockout opening; providing a blanking punch having an endless blanking edge projecting from one end thereof, which blanking edge corresponds to and is adapted to occupy said endless groove; moving said blanking punch into engagement with said material sheet so that the blanking edge occupies said groove; and then movin said blanking punch towards the material sheet for cutting the blank from the material sheet and moving same into said knockout opening.

2. A method according to claim 1, including the step of providing a knockout guide within and slidable along said knockout opening for supporting the opposite side of the blank during the cutting step by the blanking punch.

3. A method according to claim 1 or claim 2, wherein the lancing punch has a flat end surface disposed within the endless lancing edge which is adapted to abut said surface on the material sheet, and wherein the lancing punch also has an annular clearance groove formed directly inwardly from the lancing edge and projecting axially inwardly from the end surface of the punch for receiving therein the material which is deformed during formation of the groove by the lancing edge.

4. A method according to claim 1 or claim 2, including the step of forming a second endless groove of V-shaped cross section on the opposite surface of said sheet material so that said second groove coincides and is aligned with the first-mentioned groove, and thereafter cutting the blank from the sheet material by means of the blanking punch.

5. A method according to claim 4, wherein the slidable knockout member has a V-shaped edge projecting therefrom which totally occupies the second groove during the cutting step.

6. A method according to claim 1 or claim 2, wherein adjacent blanks as cut from said material sheet are in touching contact with one another to minimize waste of material.

* * * * *

UNITED STATES PATENT AND TRADEMARK OFFICE

CERTIFICATE OF CORRECTION

PATENT NO. : 4 362 078

DATED : December 7, 1982

INVENTOR(S) : Tatsuo Ohnishi, Takeshi Uemura and Teruo Nakajima

It is certified that error appears in the above—identified patent and that said Letters Patent is hereby corrected as shown below:

On the first page of the patent; change the Assignee from "Akzona Incorporated, Asheville, N.C." to ---Tsubakimoto Chain Co., Osaka, Japan---.

On the first page of the patent; change the Attorney, Agent, or Firm from "Robert H. Falk; Charles A. Wendel; Francis W. Young" to ---Blanchard, Flynn, Thiel, Boutell & Tanis---.

Col. 4, line 56; change "movin" to ---moving---.

Signed and Sealed this

*Twenty-first* Day of *February 1984*

[SEAL]

*Attest:*

GERALD J. MOSSINGHOFF

*Attesting Officer*

*Commissioner of Patents and Trademarks*